United States Patent [19]

Grose et al.

[11] Patent Number: 4,825,224

[45] Date of Patent: Apr. 25, 1989

[54] BROAD BAND IMPEDANCE MATCHING SYSTEM AND METHOD FOR LOW-PROFILE ANTENNAS

[75] Inventors: Brian L. Grose; Orval N. Skousen, both of Provo, Utah

[73] Assignee: Eyring Research Institute, Inc., Provo, Utah

[21] Appl. No.: 902,875

[22] Filed: Sep. 2, 1986

[51] Int. Cl.[4] ..... H01Q 1/50

[52] U.S. Cl. ..... 343/860; 343/822

[58] Field of Search ..... 343/820, 821, 822, 859, 343/860, 793, 719

[56] References Cited

U.S. PATENT DOCUMENTS

| | | | |
|---|---|---|---|
| 714,246 | 11/1902 | Shoemaker . | |
| 760,463 | 5/1904 | Marconi . | |
| 771,818 | 11/1904 | DeForest . | |
| 795,762 | 7/1905 | Garcia . | |
| 1,101,533 | 6/1914 | Forest . | |
| 1,123,119 | 12/1914 | De Forest . | |
| 1,220,005 | 3/1917 | Rogers et al. . | |
| 1,303,729 | 5/1919 | Rogers . | |
| 1,303,730 | 5/1919 | Rogers . | |
| 1,315,862 | 9/1919 | Rogers . | |
| 1,316,188 | 9/1919 | Rogers . | |
| 1,322,622 | 11/1919 | Rogers et al. . | |
| 1,349,103 | 8/1920 | Rogers . | |
| 1,349,104 | 8/1920 | Rogers . | |
| 1,373,612 | 4/1921 | Hanson . | |
| 1,377,129 | 5/1921 | Hahnemann . | |
| 1,387,736 | 8/1921 | Rogers . | |
| 1,395,454 | 11/1921 | Rogers . | |
| 1,424,365 | 8/1922 | Loftin et al. . | |
| 1,429,240 | 9/1922 | Hanson et al. . | |
| 1,510,799 | 10/1924 | Rogers . | |
| 1,530,129 | 3/1925 | Loftin et al. . | |
| 1,894,244 | 1/1933 | Ruble . | |
| 2,161,044 | 6/1939 | Heintz et al. | 173/367 |
| 2,225,668 | 12/1940 | Subkow et al. | 177/352 |
| 2,574,733 | 11/1951 | Enrlich | 250/33 |
| 2,712,602 | 7/1955 | Hallen | 250/33 |
| 2,834,012 | 5/1958 | Allen | 343/723 |
| 2,842,768 | 7/1958 | Halperin | 343/877 |
| 2,989,621 | 6/1961 | Barton et al. | 250/4 |
| 2,992,325 | 7/1961 | Lehan | 250/3 |
| 2,998,516 | 8/1961 | Lehan et al. | 250/5 |
| 3,183,510 | 5/1965 | Rawls | 343/719 |
| 3,212,093 | 10/1965 | Brueckmann | 343/724 |
| 3,215,937 | 11/1965 | Tanner | 325/28 |
| 3,346,864 | 10/1967 | Harmon | 343/719 |
| 3,400,402 | 9/1968 | Gallagher et al. | 343/723 |
| 3,435,457 | 3/1969 | Brueckmann | 343/719 |
| 3,577,148 | 5/1971 | Holzchuh et al. | 343/821 |
| 3,594,798 | 7/1971 | Leydorf | 343/719 |

(List continued on next page.)

FOREIGN PATENT DOCUMENTS 676331 12/1963 Canada .

OTHER PUBLICATIONS

Antenna Engineering Handbook, Second Edition, edited by Richard C. Johnson and Henry Jasik, pp. 11–18 (1961–1984).

(List continued on next page.)

*Primary Examiner*—William L. Sikes
*Assistant Examiner*—Robert E. Wise
*Attorney, Agent, or Firm*—Workman, Nydegger & Jensen

[57] ABSTRACT

A broad band impedance matching system and method for use with low-profile antennas. The system comprises an antenna formed by a pair of radiating elements positioned on or in proximity to the earth's surface. The antenna has an effective electrical length equal to one half wavelength in a given medium at the lowest frequency in a desired operating range of electromagnetic signal frequencies. Each antenna is preferably electrically insulated throughout its length. Each radiating element of the antenna system is connected to a transmission line so as to match the average magnitude of the impedance of the antenna over the desired operating range of electromagnetic signal frequencies to the impedance of the transmission line. Broad band antenna system performance may be further enhanced by configuring each radiating element such that it has two conductive arms which are joined at one end so as to be parallel or so as to form an acute angle of approximately ten degrees or less.

39 Claims, 7 Drawing Sheets

U.S. PATENT DOCUMENTS

| | | | |
|---|---|---|---|
| 3,705,407 | 9/1970 | Wickersham | 343/830 |
| 3,775,772 | 11/1973 | Carrell | 343/719 |
| 3,803,616 | 4/1974 | Kopf et al. | 343/719 |
| 3,867,710 | 2/1975 | Busignies | 340/4 R |
| 3,967,201 | 6/1976 | Rorden | 325/28 |
| 4,511,898 | 4/1985 | Bush | 343/736 |
| 4,687,445 | 8/1987 | Williams | 343/719 |

OTHER PUBLICATIONS

Drumeller, Carl C., "Travelling Wave Antennas," CQ Magazine, p. 32 (Apr. 1984).

Christinsin, Alan S., "More on the Long Haul Inverted L Long Wire" (1976).

Christinsin, Alan S., "The AFWONXX Longwire," (1976).

Misek, Victor A., "The Beverage Antenna Handbook," First Edition (1977).

English Translation of Lavrov, G. A., et al., Prizemnyye i Podzemmnyye Antenny [Near Earth and Buried Antennas], Chaper V, pp. 256–297 (1965, U.S.S.R.).

Secor, H. Winfield, "America's Greatest War Invention: The Rogers Underground Wireless," Electrical Experimenter (Mar. 1919).

Rogers, James Harris, "The Rogers Underground Aerial for Amateurs," Electrical Experimenter (Jun., 1919).

"Notes: Wireless Telegraphy With Invisible Antennae," The Electrician, No. 1,764, p. 1 (Mar. 8, 1912, Great Britain).

Kiebitz, "Recent Experiments on Directive Wireless Telegraphy With Earth Antennae," The Electrician, No. 1,764, pp. 868–870 (Mar. 8, 1912, Great Britain).

King, Ronald W. P., "The Theory of Linear Antennas With Charts and Tables for Practical Applications," pp. 436, 579–597 (1956).

The American Radio Relay League, Inc., "The A.A.R.L. Antenna Book," pp. 236–237 (1960 U.S.A.).

"Antenna Engineering Handbook," Edited by Henry Jasik, pp. 215–224 (1961).

Guy, A. W. & Hasserjian, G., "Underground Antenna Systems Design Handbook," The Boeing Company Report No. D2–7760 (Nov. 1961) also known as Design Criteria for Buried Antennas (produced under Minuteman Contract No. AF 04(647)–289).

Hasserjian, G. & Guy, A. W., "Low–Frequency Subsurface Antennas," IEEE Transactions on Antennas and Propagation, pp. 225–232 (May 1963).

Guy, A. W. & Hasserjian, G., "Impedance Properties of Large Subsurface Antenna Arrays," IEEE Transactions on Antenna and Propagation, pp. 232–240 (May 1963).

Biggs et al., "Radiation Fields of an Inclined Electric Dipole Immersed in a Semi–Infinite Conducting Medium," IEEE Transactions on Antennas and Propagation, pp. 306–310 (May, 1963).

Blair, "Experimental Verification of Dipole Radiation in a Conducting Half–Space," IEEE Transactions on Antennas and Propagation, pp. 269–275 (May, 1963).

Chen, "The Small Bare Loop Antenna Immersed in a Dissipative Medium," IEEE Transactions on Antennas and Propagation, pp. 266–269 (May, 1963) .

Fenwick et al., "Submerged Antenna Characteristics," IEEE Transactions on Antennas and Propagation, pp. 296–305 (May, 1963).

Hansen, "Radiation and Reception with Buried and Submerged Antennas," IEEE Transactions on Antennas and Propagation, pp. 207–216 (May 1963).

King et al., "The Complete Electromagnetic Field of a Half–Wave Dipole in a Dissipative Medium," IEEE Transactions on Antennas and Propagation, pp. 275–285 (May, 1963).

Wundt, R., "Buried Traveling–Wave Antennas," Applied Research Laboratory, Sylvania Electronic Systems, Research Report No. 394 (Mar. 1964).

Iisuka, "The Circular Loop Antenna Immersed in a Dissipative Medium," IEEE Transactions on Antennas and Propagation, pp. 43–47 (Jan., 1965).

Blake, LaMont V., "Antennas," pp. 209, 216–219, and 252–253 (1966).

Wolff, Edward A., "Antenna Analysis," pp. 241–267 (1966).

Galejs, "Antennas in Inhomogenous Media," vol. 15, p. 71 of Chap. 6 and Section 9.1 of Chap 9 and Section 10.3 of Chap. 10 (1969).

The Radio Amateur's Handbook, "American Radio Relay League," 1973, 50th Ed., pp. 578–581.

Lee et al., "Measured Properties of Bare and Insulated Antennas in Sand," IEEE Transactions on Antennas and Propagation, vol. AP–23, No . 5, pp. 664–670 (Sep., 1975).

Shen et al., "Measured Field of a Directiona. Antenna Submerged in a Lake," IEEE Transactions on Antenna and Propagation, pp. 891–894 (Nov., 1976).
Christinsin, Alan S., "More on the AF0NXX Sloping Long Wire," (1976).
Christinsin, Alan S., "Theoretical Performance Comparison of Two Tactical Long Wire Type Antennas Over Poor Ground," (1976).
King et al., "Subsurface Communication Between Dipoles in General Media," IEEE Transactions on Antennas and Propagation, vol. AP-25, No. 6, pp. 770–775 (Nov., 1977).
Ancona, "On Small Antenna Impedance in Weakly Dissipative Media," IEEE Transactions on Antennas and Propagation, Vo. AP @ No. 2, pp. 341–343 (Mar., 1978).
Burrell et al., "Pulse Propagation in Lossy Media Using the Low-Frequency Window for Video Pulse Radar Application," Proceedings of the IEEE, vol. 67, No. 7, pp. 981–990 (Jul., 1979).
King, et al., "A Comprehensive Study of Subsurface Propagation from Horizontal Electric Dipoles," IEEE Transactions on Geoscience and Remote Sensing, Vo. GE-18, No. 3, pp. 225–233 (Jul., 1980).
Blake, LaMont V., "Antennas," pp. 209–255 (1984).
Christinsin, Alan S., "Optimized Tactical Inverted L Antennas," (1985).
Christinsin, Alan S., "Quick Feaction Tactical HF Radio Antenna Kit," (1986).
Smith, Glenn S., "Annotated Bibliography on Buried Antennas," Georgia Institute of Technology, School of Electrical Engineering, (Feb. 1986), (produced under Government Contract No. F30602 81-C-0185).

BROAD BAND IMPEDANCE MATCHING SYSTEM AND METHOD FOR LOW-PROFILE ANTENNAS

BACKGROUND

1. Field of the Invention

This invention relates to low-profile antenna systems and to impedance matching systems and methods for use with low-profile antenna systems. More particularly, this invention relates to novel apparatus and methods for providing a broad band impedance match between a low-profile antenna and a transmission line such that the antenna system may be efficiently operated over a broad range of electromagnetic signal frequencies.

2. The Prior Art

Various types of communication systems which are based upon the propagation of electromagnetic signals have been known and used for many years. For example, commercial radio and television stations broadcast many hours of programming each day by transmitting appropriate electromagnetic signals through the atmosphere which are then received by individual radio and/or television receivers located within such station's area of broadcast. Similarly, by both transmitting and receiving suitable electromagnetic signals, government agencies, private businesses, and individuals are able to readily communicate over long distances, thereby transmitting and receiving data and/or instructions which may be vital to out nation's economy and/or security.

Generally, communication systems such as those described above employ large antennas which extend high above the earth's surface in order to effectively transmit and/or receive the desired electromagnetic signals. Such antennas are commonly referred to as "aerial" antennas. Typical aerial antennas may, for example, be secured several hundred feet above the earth's surface to the top of a high tower or building; and such antennas are also commonly supported by numerous guy wires which provide the antenna with additional structural stability. It is also quite common to install aerial antennas, together with their supporting towers and guy wires, on the slopes of relatively high mountains. By placing the antennas upon such towers and/or mountains, the range and effectiveness of the antennas can be significantly increased.

Although conventional aerial antennas are generally quite effective and may be constructed so as to operate very efficiently in both transmitting and receiving the desired electromagnetic signals, such antennas suffer from a number of significant disadvantages.

First, aerial antennas are considered "soft" for security purposes. "Hardness" and "softness" are military terms used to denote a system's vulnerability to destruction; and the "harder" a system is, the less vulnerable to destruction such system is. The "hardness" of a communication system is generally measured by such criteria as its ability to withstand substantial shock, as in the case of a powerful explosion occurring very near to the system, and the ability of the system to survive high energy electromagnetic pulse radiation which may be produced by a nuclear blast.

Unfortunately, even though a powerful explosion may be centered some distance away from the above-described aerial antennas, the resulting shock waves will likely damage or destroy such antennas, thereby rendering the associated communication systems either totally or partially inoperative. Furthermore, aerial antennas which transmit or receive high frequency electromagnetic signals are very susceptible to the adverse effects of the above-mentioned electromagnetic pulse radiation.

Some attempts have been made to increase the "hardness" of communication systems which use the above-described aerial antennas by constructing appropriate back-up antenna systems. However, both economic and environmental considerations make it very difficult to either justify or construct the number of back-up antenna systems which would be required in order to achieve an acceptable level of "hardness." Therefore, despite the general effectiveness of the conventional aerial antennas, the use of such antennas in communication systems which are vital to our national security remains highly undesirable.

Another significant drawback of prior art aerial antennas is that they generally are quite expensive, cumbersome, and time consuming to construct. Construction of an aerial antenna and its associated support structure may, for example, require several thousand dollars in materials alone. In addition, a number of laborers are usually required in order to complete construction, and conventional construction machinery and equipment are typically employed. Moreover, many man-hours of labor are generally required before the antenna system is operational.

In certain applications, such as, for example, when an antenna system will be used by military personnel, there is simply not enough time to construct a conventional aerial antenna. This is particularly true if the antenna is to be used by combat troops. In such cases, the required construction materials and equipment may also be unavailable, and the man-power requirements may likewise be prohibitive.

In military applications, there are also other important reasons for not using conventional aerial antennas. First, aerial antennas are generally immobile and cannot be easily moved from one location to another. Also, aerial antennas are relatively easy to detect and quite difficult to camouflage. It will be appreciated that both of these factors render conventional aerial antennas unsuitable for many military applications.

As a result of the above-outlined drawbacks of conventional aerial antennas, a number of attempts have been made by those skilled in the art to provide antenna systems which are easily camouflaged, economic to construct, simple to deploy, and resistant to destruction. One type of antenna system which has been investigated and which seems to have great potential may generally be referred to as a "low-profile" antenna system, in that the system is deployed at, or near (i.e., either above or below) the earth's surface.

A low-profile antenna system does not, of course, require the expensive support structure of conventional aerial antennas. As a result, a low-profile antenna system is generally much less expensive to construct than conventional aerial antenna systems. In addition, since a low-profile antenna is positioned on or near the earth's surface, and may, therefore, require little or no supporting structure, the man-power requirements for construction are significantly reduced, and the need for machinery and equipment may be virtually eliminated. Further, since a low-profile antenna system is located on or near the earth's surface, it is much easier to camouflage and is inherently less susceptible to destruction.

Despite the promising possibilities of low-profile antenna systems, however, the low-profile antenna systems of the prior art have generally been unable to provide acceptable transmission and reception characteristics. In particular, the prior art low-profile antenna systems have generally been found to be inefficient in transmission and reception, except over a relatively narrow band of electromagnetic signal frequencies.

While operation of an antenna at a single signal frequency, or over a relatively narrow range of frequencies, may be acceptable for some applications, broad band operation is most desirable. For example, in military applications, messages are generally transmitted at several different signal frequencies, and the signal frequency is often changed in some manner during the transmission. In this way, it becomes much more difficult for unauthorized personnel to intercept the transmitted message, and hostile groups or forces are less likely to be able to jam or distort the transmitted message.

Significantly, since the prior art low-profile antenna systems are generally not suited to broad band operation, such antenna systems are not able to efficiently transmit or receive portions of the message. Only those portions of the message which are transmitted at a frequency which is within the narrow operating band of frequencies for which the low-profile antenna system was designed can be efficiently transmitted or received. Portions of the message which are transmitted at other frequencies may be either weak or lost entirely.

Although some attempts have been made to adapt low-profile antenna systems for operation over a broad range of signal frequencies, such attempts have heretofore proven unacceptable. The prior art attempts to provide a broad band low-profile antenna system have generally been quite cumbersome, requiring complex tuning mechanisms or other system adjustments. As a result, the prior art low-profile antenna systems have not been able to provide acceptable operation characteristics which are needed for many applications.

BRIEF SUMMARY AND OBJECTS OF THE INVENTION

In view of the foregoing, it is a primary object of the present invention to provide a low-profile antenna system and method which is capable of efficient operation over a wide band of electromagnetic signal frequencies.

Additionally, it is an object of the present invention to provide a low-profile broad band antenna system and method which requires no tuning or other system adjustment when operating at various different signal frequencies.

It is also an object of the present invention to provide a simple method for matching the impedance of a low-profile antenna to the impedance of a transmission line such that the impedance match is effective over a wide band of electromagnetic signal frequencies.

Further, it is an object of the present invention to provide a low-profile broad band antenna system and method which is resistant to destruction and easily camouflaged.

It is still further object of the present invention to provide a low-profile broad band antenna system which is easy to deploy and which does not require a large amount of space for deployment.

Also, it is an object of the present invention to provide a low-profile broad band antenna system which is readily portable.

Consistent with the foregoing objects, the present invention is directed to a broad band impedance matching system and method for use with low-profile antennas. The antenna typically comprises two radiating elements which are positioned on or in proximity to the earth's surface. The antenna has an effective electrical length equal to at least one-half wavelength in the medium at the lowest desired electromagnetic signal frequency, and the antenna is preferably electrically insulated throughout its length. Importantly, each radiating element of the antenna system is coupled to a transmission line such that the impedance of the transmission line is substantially matched to the average magnitude of the impedance of each radiating element over the desired operating range of electromagnetic signal frequencies.

Broad band antenna performance may be further enhanced by configuring each radiating element of the antenna system such that it has two substantially colinear conductive arms. Each conductive arm comprises two substantially linear electrical conductors which are joined at one end so as to form an acute angle of typically ten degrees or less.

These and other objects and features of the present invention will become more fully apparent from the following description and appended claims, taken in conjunction with the accompanying drawings.

DETAILED DESCRIPTION OF THE PREFERRED EMBODIMENTS

Figure 1:
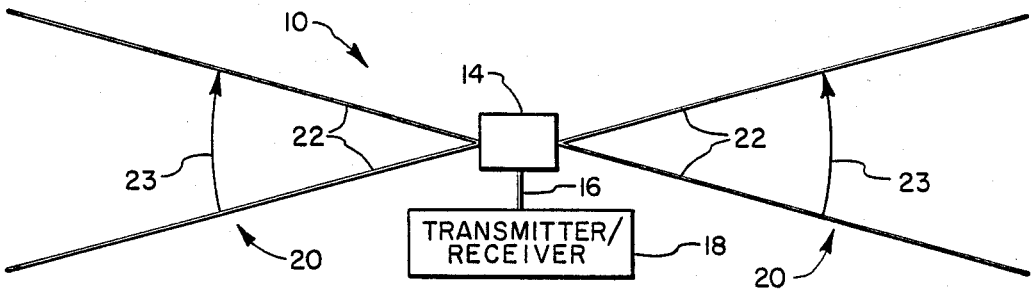
FIG. 1 is a top plan view of one presently preferred embodiment of the low-profile broad band antenna system of the present invention.

It will be readily appreciated that the components of the present invention, as generally described and illustrated in the figures herein, could be arranged and designed in a wide variety of different configurations. Thus, the following more detailed description of the embodiments of the system and method of the present invention, as represented in FIGS. 1 through 11B, is not intended to limit the scope of the invention, as claimed, but it is merely representative of the presently preferred embodiments of the invention.

The presently preferred embodiments of the invention will be best understood by reference to the drawings, wherein like parts are designated with like numerals throughout.

1. General Discussion

A significant factor in the efficiency of any antenna system is whether the impedance of the antenna is properly matched to the impedance of the transmission line on which electromagnetic signals are being carried to and from the antenna. Basically, impedance is a measure of the opposition which is offered by an electric circuit (measured in units called "ohms") to the flow of electrical current through the circuit. Impedance has two components: "resistance" and "reactance." Especially at higher electromagnetic signal frequencies, a communication system operates most efficiently when the impedance of the antenna is approximately matched to the impedance of the transmission line, with the reactive component of the impedance being approximately zero.

When there is an impedance mismatch between an antenna and its transmission line, an electromagnetic signal is partially reflected at the point of the impedance discontinuity. As a result, not all of the electromagnetic signal energy can be used in transmission or reception. In addition, the electromagnetic reflected signal results in various other energy losses along the transmission line such as, for example, dielectric losses.

Significantly, the reflected signal also establishes a standing wave on the transmission line. Such standing wave may produce high voltages and excessive currents at various points along the transmission line. If there is an extreme impedance mismatch, the high voltages and currents may exceed the capacity of the antenna system, which may result in damage to the various components of the antenna system.

A ratio which is widely used by engineers and technicians to quantify the amount of signal reflection which is taking place between an antenna and a transmission line is called the "voltage standing-wave ratio" ("VSWR"). VSWR is defined mathematically, as follows:

$$VSWR = \frac{1 + \left|\frac{Z_L - Z_O}{Z_L + Z_O}\right|}{1 - \left|\frac{Z_L - Z_O}{Z_L + Z_O}\right|}; \text{ where}$$

$Z_L$=the magnitude of the antenna impedance; and $Z_0$=the magnitude of the transmission line impedance.

From the foregoing equation, it is evident that when the antenna impedance is perfectly matched to the transmission line impedance (that is, when $Z_L=Z_0$), VSWR=1. Thus, when matching the impedance of an antenna to that of a transmission line, it is desirable to maintain the VSWR as close to the value "1" as practical.

When matching the impedance of an antenna to that of a transmission line, two steps are generally undertaken. First, the antenna is constructed such that the reactive component of the impedance is nearly zero at the desired operating frequency. That is, the antenna is constructed so as to be approximately "resonant" at the desired frequency. Then, a transmission line is selected which has approximately the same impedance as that of the antenna at the operating frequency; or, more commonly, an appropriate impedance matching device is used to connect the antenna to the transmission line.

Impedance matching devices are well known in the art and may have a variety of different configurations, depending upon the configuration of both the transmission line and the antenna. One common type of impedance matching device which is particularly adapted for use when the transmission line is a coaxial transmission cable, is called a balance-to-unbalance transformer (commonly referred to as a "balun"). When using a balun, the balun is configured so as to have a suitable impedance step-up ratio such that the impedance of the transmission line is substantially matched to the impedance of the antenna. For example, if the antenna impedance is twice the impedance of the transmission line, the balun would have a step-up impedance ratio of two-to-one. In this way, the antenna system is made to behave as if there were no impedance discontinuity.

One of the difficulties which is encountered when matching the impedance of an antenna to that of a transmission line results from the well-known fact that the impedance of the antenna may vary significantly depending upon the frequency of the electromagnetic signals being propagated or received. Thus, if the impedance of the antenna and transmission line are matched at one frequency, they may be extremely mismatched at another frequency.

Consequently, when matching the impedance of conventional prior art antennas, the engineer or technician first selects the electromagnetic signal frequency at which the system will operate. The antenna impedance is then determined at that specific frequency. Finally, the antenna impedance at the operating frequency is matched to the transmission line impedance.

It will be readily appreciated that the foregoing procedure gives good results at the single, specific frequency for which the antenna was properly matched. Slight variations in frequency may also provide acceptable results, even though an exact impedance match is not present at such other frequencies. The result is that conventional antenna systems generally have acceptable operating efficiency over only a very narrow band of electromagnetic signal frequencies. Good broad band performance is generally not obtained without subsequent tuning or adjustment.

In constructing an antenna system in accordance with the present invention, on the other hand, each radiating element is selected such that the effective electrical length of the antenna is at least one half wavelength in the medium at the lowest desired operating frequency when the antenna is placed on or in sufficient proximity to the earth's surface. As used herein, medium means that medium in which the antenna is intended for operation, which in the present invention includes the contained interaction of air and earth with the antenna. Typically, the antenna may be operated in a given segment of several octaves anywhere in the LF to VHF frequency range.

With the antenna system so positioned and selected, each radiating element is then coupled to the transmission line of the system so as to effectuate an appropriate impedance match. Unlike prior art antenna systems, however, the impedance of the antenna is not matched to the impedance of the transmission line at a particular frequency. Rather, the average magnitude of the antenna impedance over the desired range of operating frequencies is first determined, and then matched to the transmission line impedance. The antenna may then be efficiently operated over the entire range of operating frequencies without the need for any system adjustment or tuning.

2. The Antenna System Configuration

Figure 2:
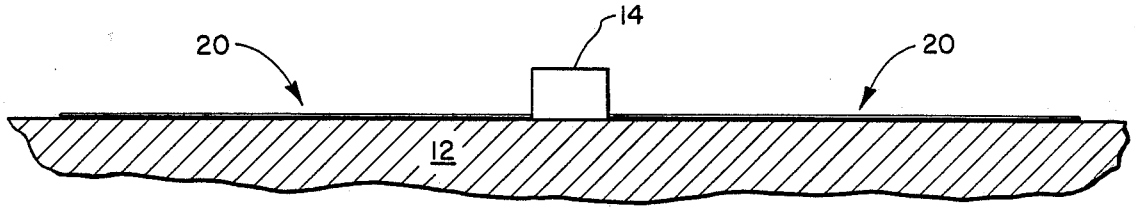
FIG. 2 is a side elevation view of the embodiment of FIG. 1 wherein each radiating element of the antenna system is deployed on the surface of the earth.
Figure 1A:
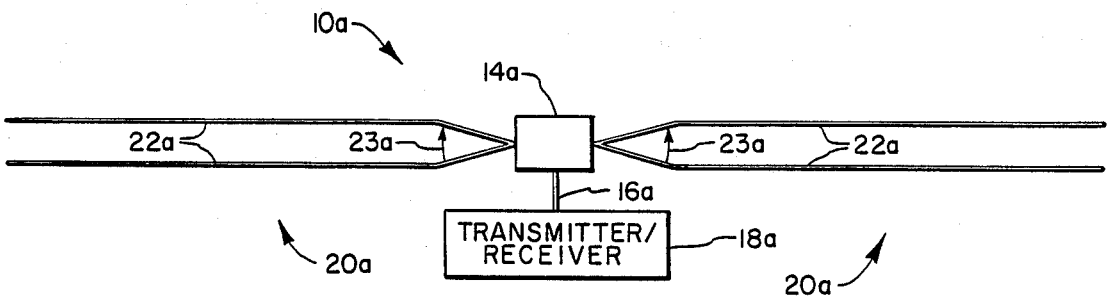
FIG. 1*a* is a top plan view of another embodiment of the antenna system of the present invention.

With reference to FIGS. 1 and 2, the antenna system of the present invention, generally designated at 10, comprises two radiating elements generally designated at 20 which are positioned on the earth's surface 12 and are connected at one end thereof to a conventional coupler device 14. Each radiating element 20 of antenna system 10 may have any of a number of suitable configurations. For example, as illustrated in FIG. 1 and as hereinafter more fully explained, each radiating element 20 may comprise two substantially colinear conductive arms 22 which are joined at one end to form a "V" element. Alternatively, each radiating element could comprise a pair of parallel radiating elements as shown in FIG. 1*a*. Each radiating element could also comprise only a single conductive arm 22.

As depicted in FIG. 1, it is presently preferred that conductive arms 22 be substantially the same length such that the radiating elements 20 are driven from a point near their center. This yields a substantially bidirectional radiation pattern. Alternatively, a more unidirectional pattern may be obtained by forming one radiating element 20 substantially longer than the other. In that case, the radiation intensity would be at a maximum in a direction along the longest radiating element 20.

As mentioned above, radiating elements 20 may each comprise two substantially linear conductive arms 22 which are joined adjacent one end so as to be parallel or so as to form an acute angle as indicated at the arrow 23. Preferably, angle 23 should be approximately ten degrees or less when it is desired that the beam width of the radiation pattern of antenna system 10 not be significantly affected. The configuration of conductive arms 22 illustrated in FIG. 1 has been found to increase broad band performance of antenna system 10, as will be set forth in more detail below.

Figure 6:
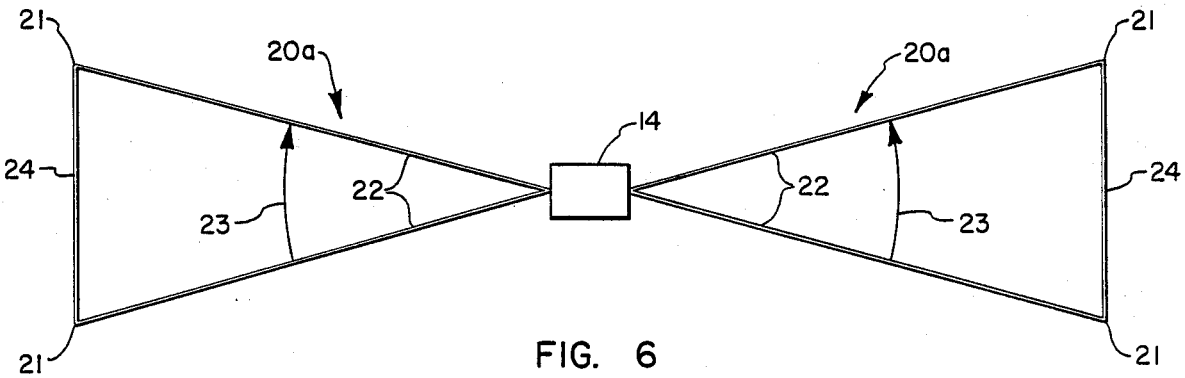
FIG. 6 is a top plan view of a second presently preferred embodiment of the low-profile broad band antenna system of the present invention.

FIG. 6 illustrates an alternative configuration for radiating elements 20 of antenna system 10. As shown, radiating elements 20*a* may each be configured as an isosceles triangle. This may be done by adding an end conductor 24 so as to connect the outer ends of conductive arms 22. of course, it will be readily appreciated that conductive arms 22 and end conductor 24 may comprise a single length of conductor which is configured as a triangle.

In addition to the triangular configuration illustrated in FIG. 6, end conductor 24 may have an arcuate or angular configuration, or end conductor 24 may have any other configuration which is suitable to the terrain. End conductor 24 typically does not have any significant effect upon the radiation pattern or operation of antenna system 10, but may be useful to simply insure that the proper angle 23 is achieved. For example, where a single length of conductor is used, if the ends 22*a* of conductive arms 22 are marked then the length of end conductor 24 will insure that angle 23 does not exceed the desired angle so as to affect the beam width of the radiating pattern when such is not desired.

Conductive arms 22 should be configured such that the effective electrical length of antenna system 10 is at least one half wavelength in the medium at the lowest electromagnetic signal frequency at which antenna system 10 will be operated. Thus, for example, if antenna system 10 is to be operated on or near an earth surface where the speed of the electromagnetic signal propagated along the antenna approximates 0.8C (where C is the speed of light in free space), and is operated at frequencies down to about 2 MHz, each radiating element 20 should be at least 100 feet (30.48 meters) long such that the entire antenna system 10 is approximately 200 feet (60.96 meters) long. However, in many applications the effective electrical length of the antenna will preferably be one wavelength or longer in the medium at the lowest operating frequency.

It will be appreciated that the length of conductive arms 22 of antenna system 10 will progressively increase as it is desired to operate antenna system 10 at lower frequencies. At some point, it may become prohibitive to configure conductive arms 22 of antenna system 10 so as to have the required actual physical length. This is particularly true if antenna system 10 is to be located beneath the earth, since excavating costs may become too high. In such cases, the radiating elements 20 of antenna system 10 may be configured as depicted in FIG. 7.

Figure 7:
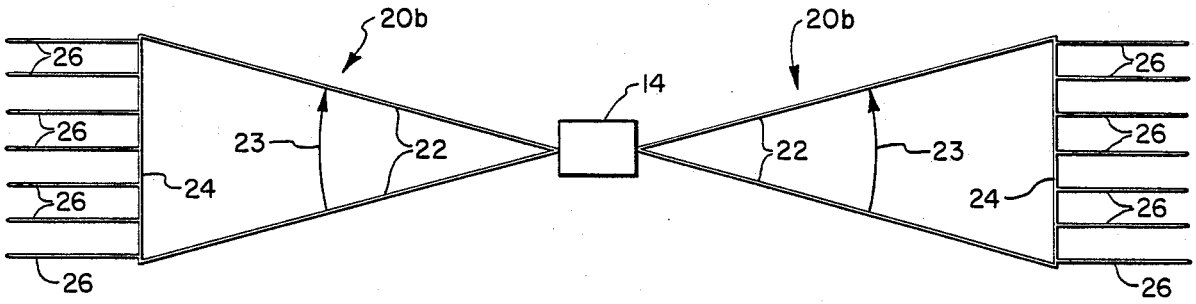
FIG. 7 is a top plan view of a third presently preferred embodiment of the low-profile broad band antenna system of the present invention.

As shown in FIG. 7, each radiating element 20*b* may be formed as an isosceles triangle, as described above in connection with FIG. 6. In addition, a plurality of tree terminations 26 may be connected to the end conductor 24 of each radiating element 20*b*. Tree terminations 26 are substantially parallel linear electrical conductors and are electrically connected to end conductors 24.

The purpose of tree terminations 26 is to increase the capacitive coupling of the antenna to the earth, thus increasing the effective electrical length of radiating elements 20*b* without significantly increasing their actual physical length. By appropriate selection of the number and spacing of tree terminations 26 therefor, therefore, radiating elements 20*b* may be made to electrically approximate a desired physical length. As a result, even though radiating elements 20*b* of antenna system 10 do not have the actual physical length which would normally be required for a given range of operating signal frequencies, tree terminations 26 increase the effective electrical length by increasing capacitive coupling to the earth such that antenna system 10 will operate effectively for the given range of frequencies.

Conductive arms 22 of antenna system 10 may be formed of any suitable material. For example, conductive arms 22 may be formed of stainless steel or copper. Alternatively, conductive arms 22 may be formed of phosphor-bronze wire.

Conductive arms 22 of antenna system 10 are also preferably insulated from the surrounding environment. For above-ground applications, conductive arms 22 may be surrounded or coated with materials such as nylon, teflon, or rubber. When conductive arms 22 are to be buried in the earth, however, it is desirable to insulate conductive arms 22 with a material which is resistant to water and rodents. Accordingly, conductive arms 22 could, in such cases, be insulated with materials such as polyethylene or polyvinyl chloride. In subsurface applications the insulating layer should be much thicker than used in above surface applications. The ratio of total diameter to conductor diameter should preferably be approximately 2 to 1.

FIGS. 2–5 illustrate various ways in which the radiating elements 20 of antenna system 10 may be deployed. The particular deployment configuration which is selected will depend upon the particular application (i.e., radiation pattern) and upon the condition of the surrounding environment (i.e., wet or dry ground, and conductivity and dielectric characteristics of the ground).

As shown in FIG. 2, radiating elements 20 may be placed directly upon the surface of the earth 12. Such a method of deployment is very simple and may be done quite rapidly. Thus, for example, if radiating elements 20 are formed of an insulated conductive cable which is wound upon a spool, the cable could be quickly laid upon the surface of the earth as illustrated in FIG. 2.

Figure 3:
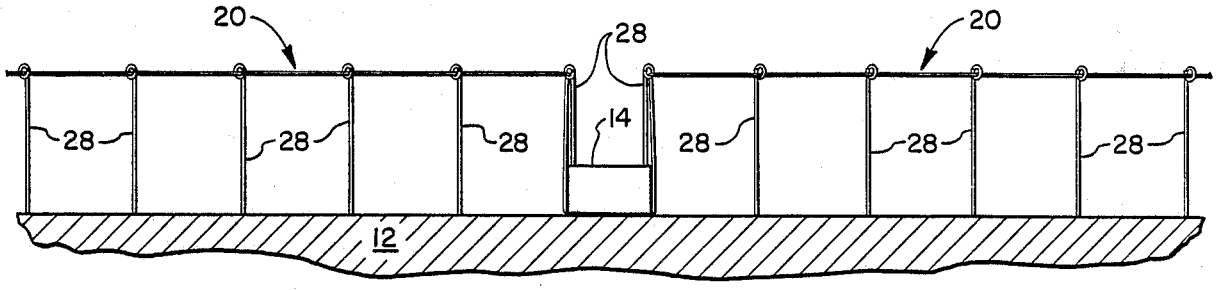
FIG. 3 is a side elevation view of the embodiment of FIG. 1 wherein each radiating element of the antenna system is deployed above the surface of the earth by means of stakes.

In some cases the earth may be too conductive to allow efficient operation of the antenna with radiating elements 20 directly upon the surface of the earth. This may be the case in marsh areas or on rich agricultural soil. It may, therefore, be desirable to elevate radiating elements 20 above the surface of the earth 12 by means of stakes 28, as depicted in FIG. 3. This type of antenna configuration will help minimize energy losses due to the conductivity of the earth.

Figure 4:
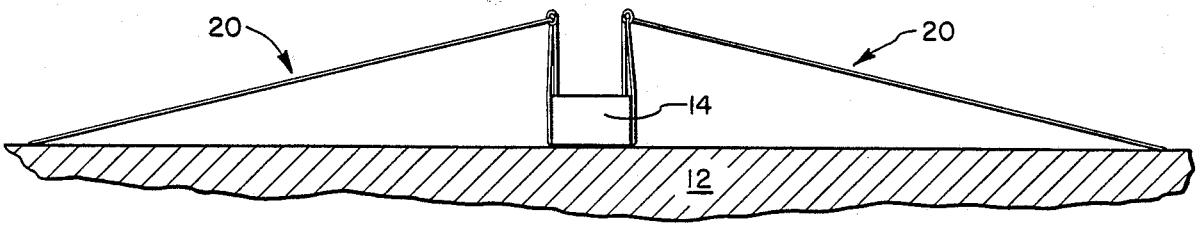
FIG. 4 is a side elevation view of the embodiment of FIG. 1 wherein the radiating elements of the antenna system are elevated and inclined downwardly toward the surface of the earth.

In other applications, it may be desirable to approximate an end-loaded long wire antenna. In such cases, it may be desirable to elevate a portion of radiating elements 20 while maintaining the end portions of each element 20 in close proximity to the earth 12 so as to increase capacitive coupling thereto. FIG. 4 illustrates one such configuration which may be used to accomplish this result in that radiating elements 20 are elevated at their inner ends but gradually slope downward toward the earth 12 along their length.

Figure 5:
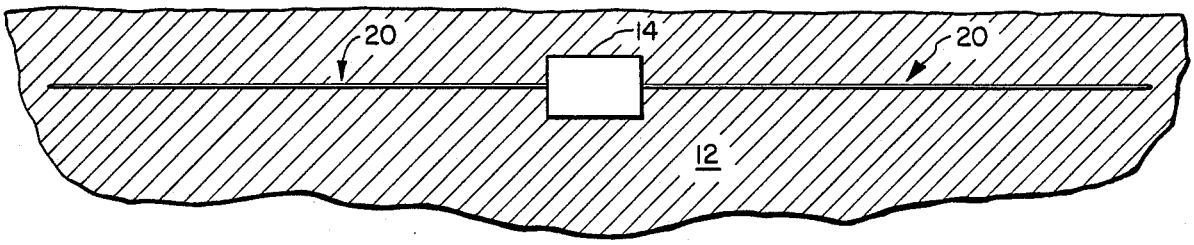
FIG. 5 is a side elevation view of the embodiment of FIG. 1 wherein each radiating element of the antenna system is deployed beneath the surface of the earth.

In other applications, antenna system 10 may be hardened by burying the radiating elements 20 in the earth 12, as depicted in FIG. 5. Advantageously, by burying the radiating elements 20, the hardness of the system is greatly increased, and the antenna system 10 is much more difficult to detect.

Regardless of which specific deployment configuration is selected, it is desirable to maintain radiating elements 20 in sufficient proximity to the surface of the earth 12 to create a substantial interaction between the radiating elements 20 and surface 12 so that the impedance variations of the elements 20 are substantially damped over the selected range of operating frequencies. It is presently preferred, for example, that the radiating elements 20 be elevated approximately three feet (0.91 meters) above the earth's surface for above-ground applications. Similarly, it is presently preferred that elements 20 be buried in the earth approximately two feet (0.61 meters) for below-surface configurations.

3. Examples of Antenna System Performance

As depicted in FIG. 1, conductive arms 22 are connected to a coupler device 14 such as an impedance matching transformer. Coupler device 14 is in turn connected to a transmission line 16, and transmission line 16 is connected to a transmitter/receiver apparatus 18. Significantly, coupler device 14 is selected such that the average magnitude of the impedance of conductive arms 22 over the desired operating range of electromagnetic signal frequencies is matched to the impedance of transmission line 16 when the antenna system is placed in sufficient proximity to the earth's surface to substantially damp the impedance variations of the antenna radiating elements.

When antenna system 10 of the present invention is configured in the manner set forth above, antenna system 10 will operate efficiently over a broad band of electromagnetic signal frequencies. Following are examples of the system performance.

EXAMPLE 1

Figure 8A:
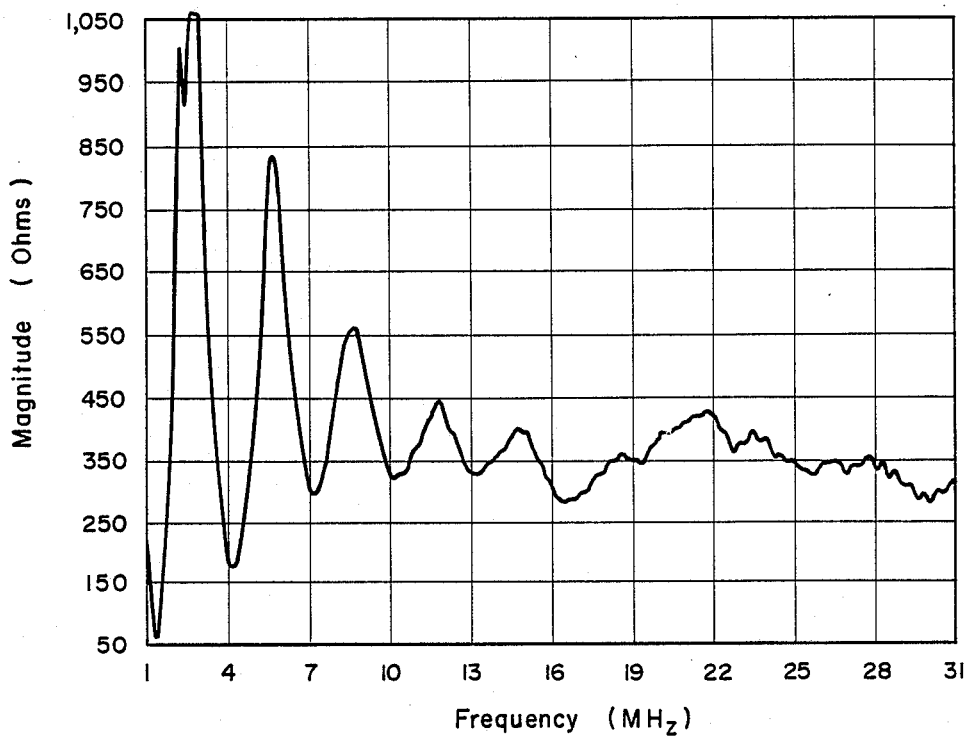
FIGS. 8A, 8B, 9A, 9B, 10A, 10B, 11A, and 11B are antenna impedance magnitude and phase graphs for various low-profile antenna configurations.
Figure 8B:
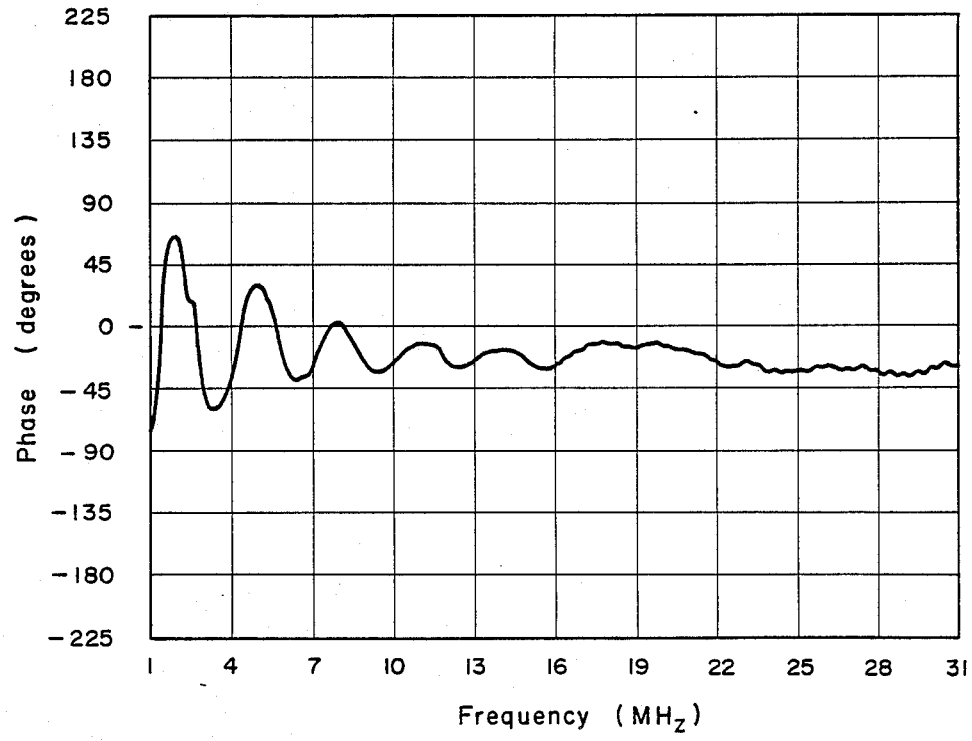

FIGS. 8A and 8B illustrate the impedance magnitude and phase, respectively, of a radiating element having two 100 foot (30.48 meter) conductive arms 22. The conductive arms consisted of #18 phosphor-bronze wire with rubber insulation, and were placed directly upon an asphalt surface and operated over the range of frequency from approximately 2 to 31 MHz.

In the prior art, as outlined above, one would normally attempt to construct each radiating element 20 such that it had no reactive impedance at a desired operating frequency (that is, the phase of the impedance would equal approximately zero at that frequency). Then, an impedance matching device would be selected so as to match the impedance of the antenna to the impedance of the transmission line 16 at that particular operating frequency.

In accordance with the present invention, on the other hand, the average magnitude of the impedance over the desired operating range is first determined. For example, for the antenna system as described above the average magnitude of the impedance over the frequency range of 2–31 MHz was determined from FIG. 8A to be approximately 450 ohms. Thus, if transmission line 16 is a 50 ohm coaxial transmission line, coupler device 14 could be a balun having a step-up impedance ratio of anywhere from approximately six-to-one to nine-to-one. Of course, it will be readily appreciated that other types of impedance matching devices could also be used.

Significantly, it should be noted that the impedance magnitude depicted in FIG. 8A is for a radiating element in sufficient proximity to the earth's surface (in this case, directly on an asphalt surface) to substantially damp the impedance variations of the antenna system. If the radiating element is not in sufficient proximity to the earth's surface, the peak-to-peak excursions of the impedance would be much larger than depicted in FIG. 8A, and the average impedance magnitude would likely be much different than 450 ohms. When the radiating element is in sufficient proximity to the earth's surface, on the other hand, FIG. 8A illustrates that the impedance magnitude excursions are damped, particularly toward the higher frequencies.

It should also here be noted that since antenna system 10 is to be operated over a broad band of electromagnetic signal frequencies, it is, of course, desirable that coupler device 14 have characteristics which do not vary significantly over the frequency range of interest. Thus, for example, if coupler device 14 is a balun, it should be designed so that its step-up impedance ratio is virtually constant over the entire range of electromagnetic signal frequencies at which antenna system 10 will be operated.

EXAMPLE 2

Figure 9A:
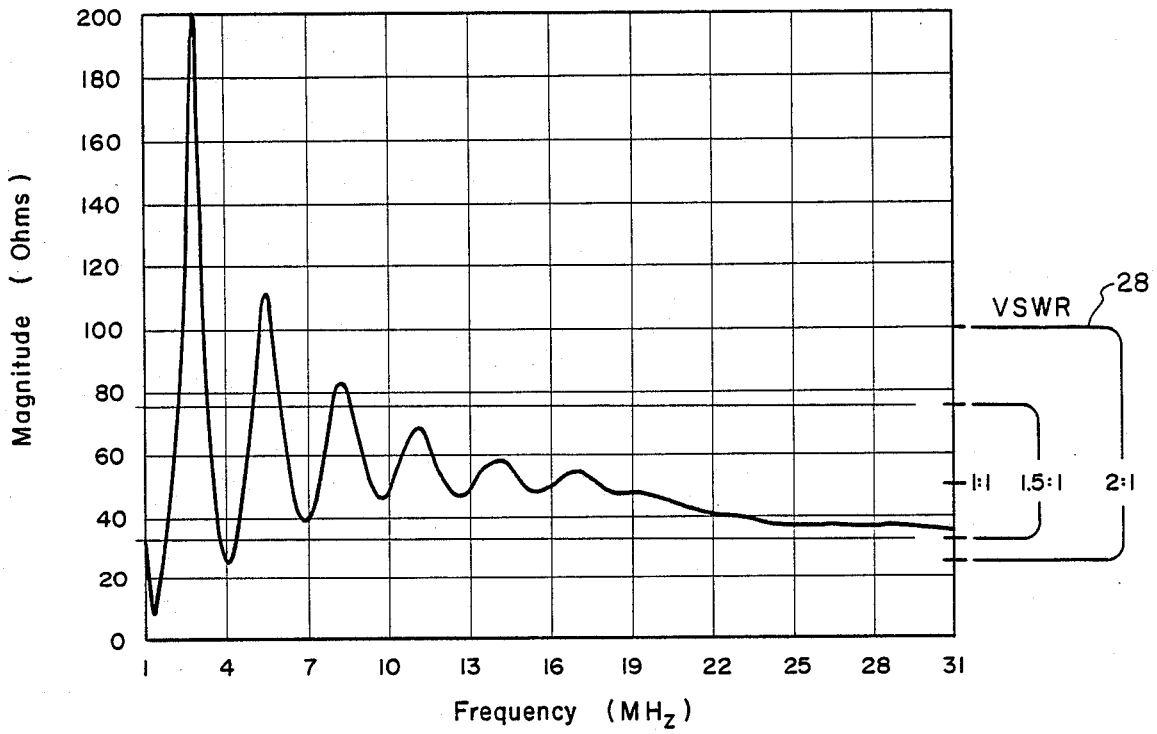

The antenna system in this case was the same as that previously described in connection with Example 1. Conductive arms 22 were each 100 feet (30.48 meters) in length and were constructed of #18 phosphor-bronze cable having rubber insulation. However, unlike the system in Example 1, in this case impedance of the antenna system was matched to the impedance of a 50 ohm coaxial transmission line by coupling the antenna system to the coaxial transmission line through a balun having a step-up impedance ratio of nine-to-one. The antenna system was then operated over the same range of frequency as set forth in Example 1. Thus, FIGS. 9A and 9B illustrate the effect achieved by using the nine-to-one balun to match the antenna system's impedance to the transmission line impedance.

Figure 9B:
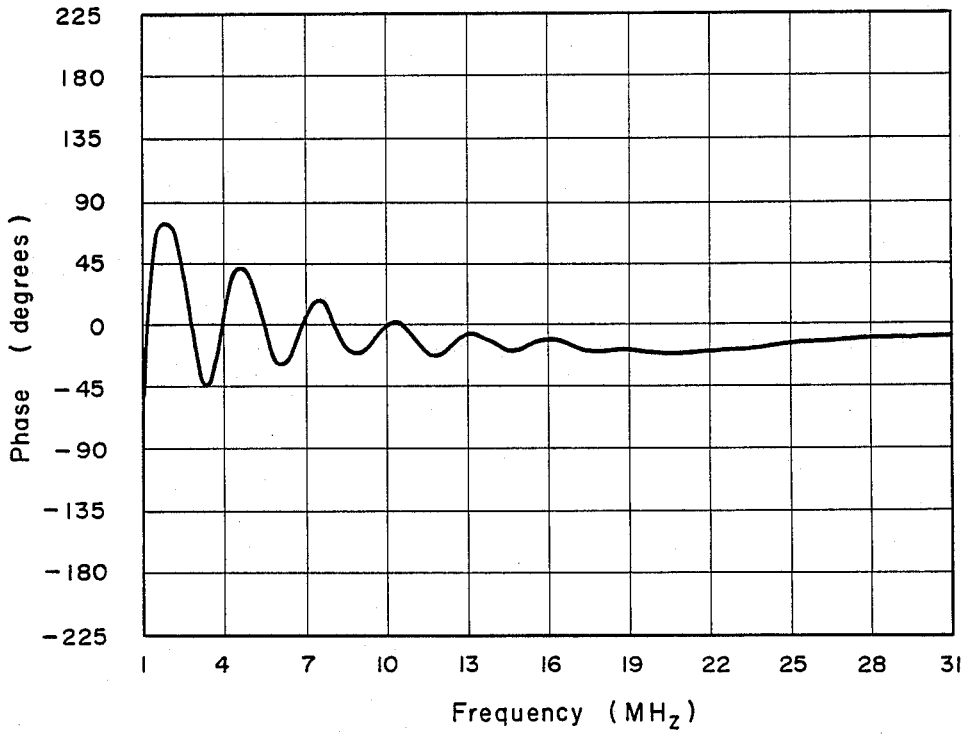

From FIG. 9B, it was noted that the change in phase of the impedance was relatively small over the frequency range from 2 MHz to 31 MHz. It was also noted from FIG. 9A that the effective magnitude of the antenna impedance was quite close to 50 ohms over most of the frequency range. In fact, as shown by the bracket 28, the VSWR was less than two-to-one throughout the desired range of operating frequencies. Thus, using the nine-to-one ratio, antenna system 10 operated efficiently over substantially the entire range of frequencies from 2 MHz to 31 MHz, as desired.

EXAMPLE 3

Figure 10A:
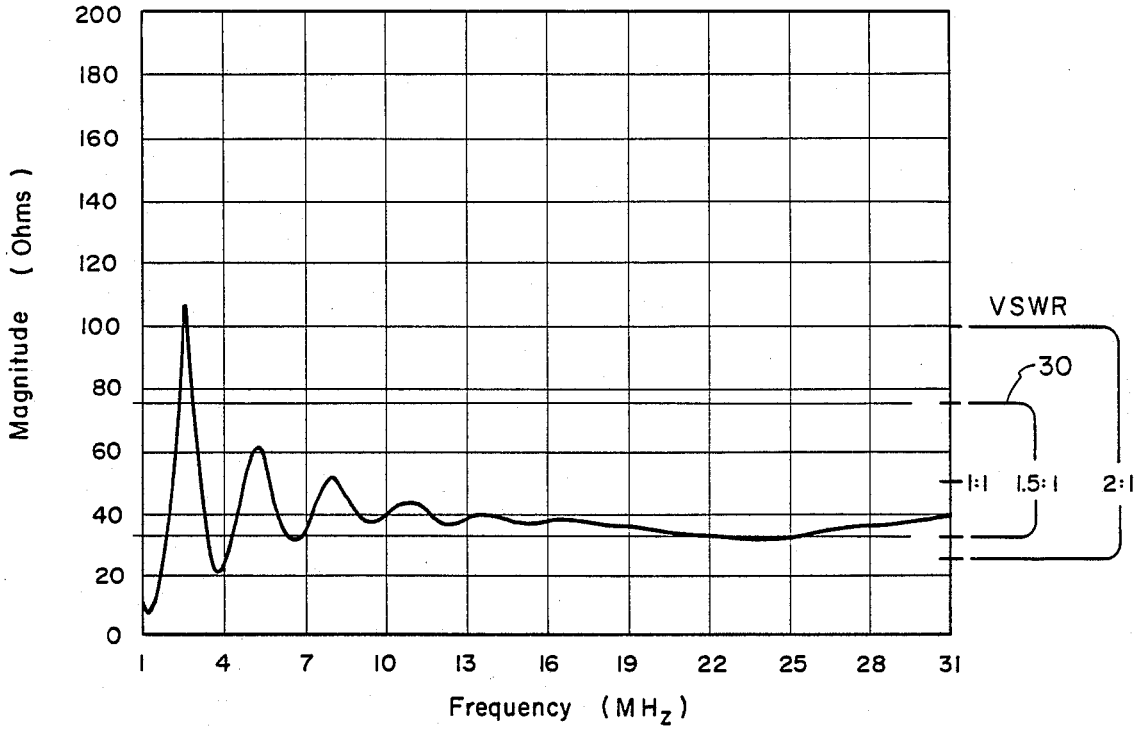
Figure 10B:
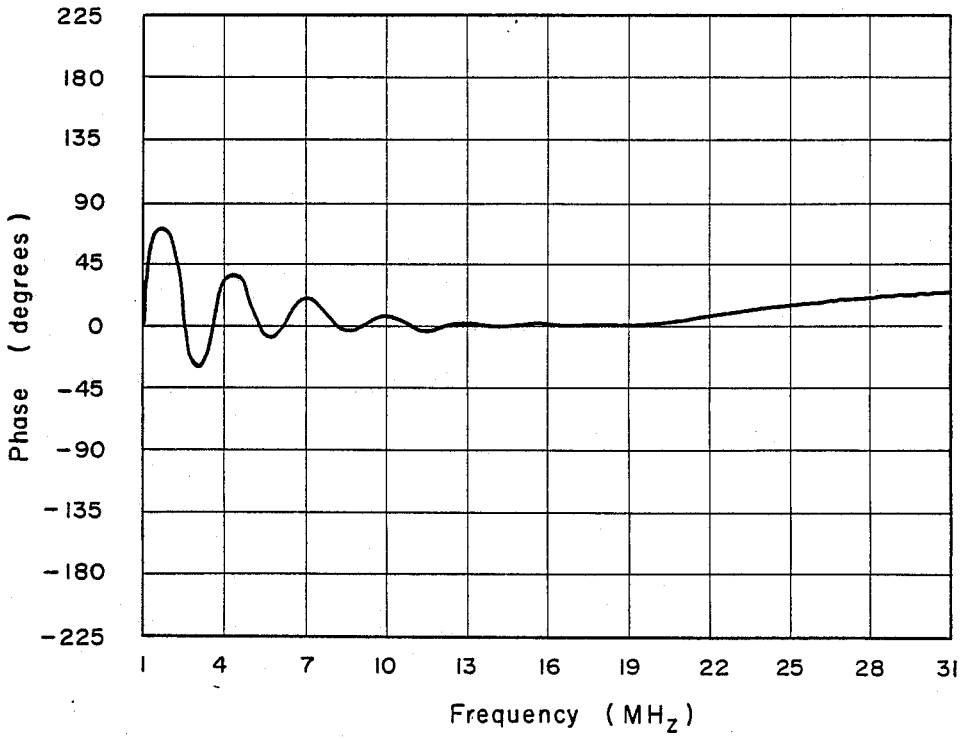

FIGS. 10A and 10B illustrate the antenna impedance magnitude and phase, respectively, when radiating elements 20 were configured as isosceles trianges having an acute angle 23 (see FIG. 6). Again, number 18 phosphor-bronze wire with rubber insulation was used, with the length of each conducting arm 22 being about 100 feet (30.48 meters). The acute angle 23 was approximately 5.73 degrees. As in the case of Example 2 above, in this case the antenna system was again coupled to a 50 ohm coaxial transmission line using a balun having a step-up impedance ratio of nine-to-one.

FIG. 10A demonstrates that the effective magnitude of the impedance of the radiating elements for this configuration was approximately 50 ohms throughout the frequency range of interest (2 MHz–31 MHz). In addition, the VSWR for the system was less than or equal to 1.5 throughout that frequency range, as shown by bracket 30. Also, FIG. 10B indicates that the change in phase was much closer to zero throughout the frequency range of interest. Thus, this configuration showed improved performance over the system of Example 2.

EXAMPLE 4

Figure 11A:
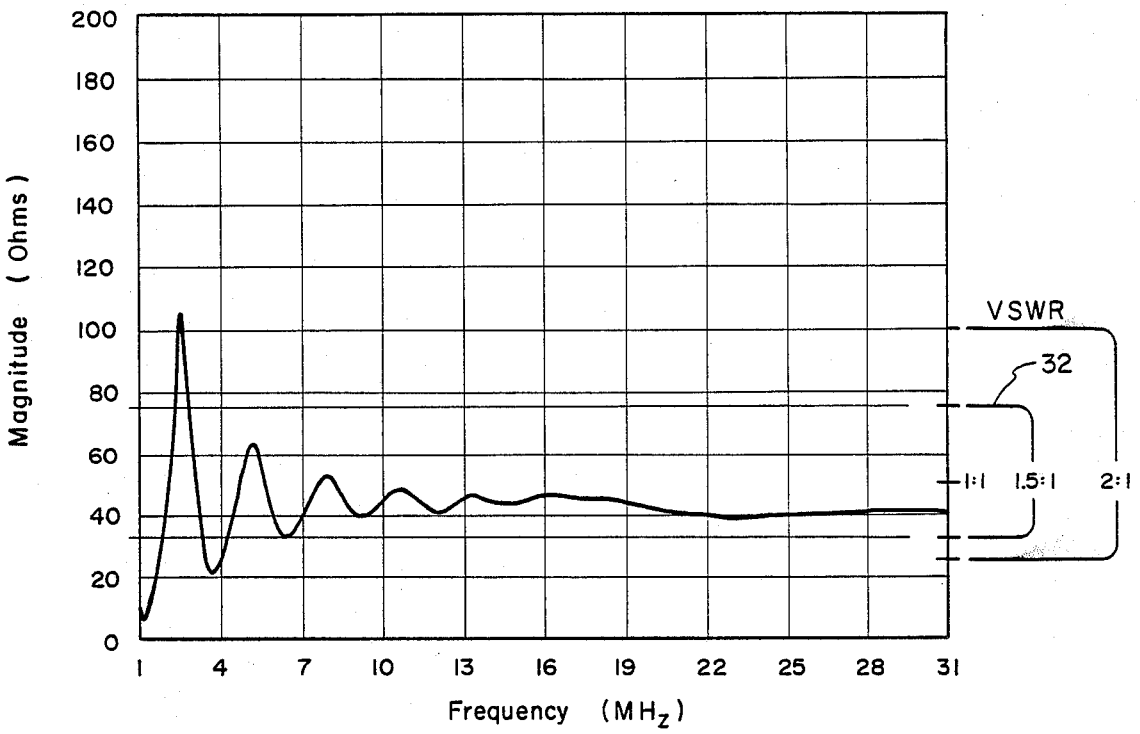
Figure 11B:
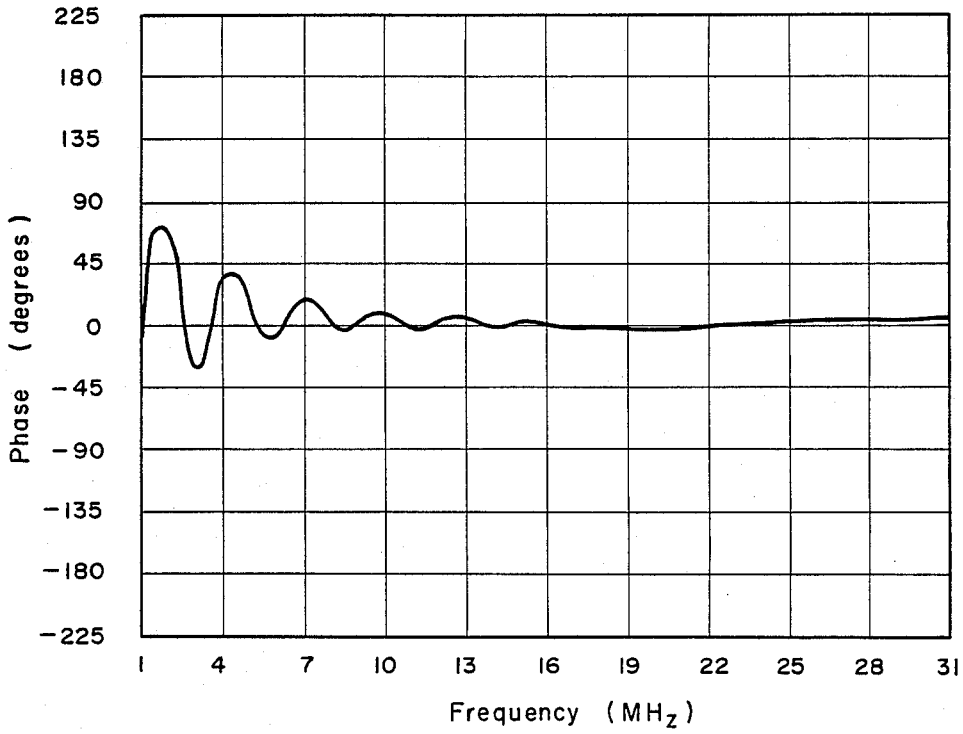

FIGS. 11A and 11B illustrate the antenna impedance magnitude and phase, respectively, when the same configuration was used as in Example 3, except that the angle 23 between the conductive arms 22 was decreased to approximately 1.15 degrees. As can be readily seen, the change in phase of the impedance, as shown in FIG. 11B, was very close to zero throughout most of the frequency range of interest. As before, the magnitude of the antenna impedance was very near to 50 ohms throughout the frequency range of interest, and the VSWR was less than 1.5 throughout such frequency range as shown by bracket 32. Accordingly, the antenna system proved to be capable of very efficient operation throughout the frequency range of from approximately 2 MHz to 31 MHz.

4. Summary

From the above discussion, it will be appreciated that the present invention provides a low-profile antenna system which is capable of efficient operation over a wide band of electromagnetic signal frequencies. When placed in sufficient proximity to the surface of the earth to substantially damp the impedance variations of the antenna, and by matching the average magnitude of the impedance of each radiating element for a given configuration and mode of deployment to the impedance of the transmission line, the VSWR is significantly improved over a broad range of signal frequencies at which the antenna system may be operated. In addition, the efficiency and broad band capabilities of the system may be further enhanced by configuring each radiating element of the antenna system as two substantially linear conductive arms which are joined together at one end so as to be parallel or so as to form an acute angle. Where it is desired that the beam width not be substantially altered, the angle should preferably be approximately ten degrees or less.

It will also be appreciated that the present invention has provided a low-profile broad band antenna system wherein the impedance of the antenna may be matched to that of the transmission line in a simple manner, and wherein the system does not require tuning or adjustment as the frequency is changed. The present invention may be deployed on or slightly above the surface of the earth and is, therefore, easily camouflaged and adaptable to many different situations; and the system may be provided with additional "hardness" by burying the conductive arms of the antenna in the earth. Thus, it will be appreciated that the present invention has provided a portable antenna system which is easy to deploy and which can be effectively and efficiently operated over a broad band of electromagnetic signal frequencies.

The invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by U.S. Patent is:

1. A method for matching the impedance of each radiating element of a low-profile antenna system to the impedance of a transmission line, the method comprising the steps of:

obtaining one or more radiating elements which each have an effective electrical length that is at least one half wavelength for a given medium at the lowest frequency in a desired operating range of electromagnetic signal frequencies;

capacitively coupling each said radiating element to the earth's surface so that the impedance variations of each said radiating element are substantially damped over said selected range of operating signal frequencies; and coupling each radiating element to the transmission line through an impedance matching means, and essentially matching means being selected such that the average magnitude of the impedance of the antenna to the impedance of the transmission line by means of said impedance matching means.

2. A method as defined in claim 1 wherein said configuring step comprises electrically insulating each radiating element substantially throughout its length.

3. A method as defined in claim 1 wherein said system comprises two radiating elements and wherein said coupling step comprises connecting the impedance matching means between said radiating elements.

4. A method as defined in claim 3 wherein said radiating elements are substantially equal in length.

5. A method as defined in claim 4 wherein said desired operating range of electromagnetic signal frequencies comprises at least two octaves selected from a frequency range of from 30 KHz to 300 MHz.

6. A method as defined in claim 5 wherein said effective electrical length of the radiating elements is approximately 200 feet (60.96 meters).

7. A method as defined in claim 5 wherein said transmission line is a 50 ohm coaxial transmission line and wherein said impedance matching means comprises a balance-to-unbalance transformer having an impedance step-up ratio of approximately nine-to-one.

8. A method as defined in claim 3 wherein each said radiating element comprises two substantially linear conductive arms, each said conductive arm having a first end and a second end, the first ends of the conductive arms being joined so as to form an acute angle, and wherein the coupling step comprises connecting the impedance matching means to said first ends of the conductive arms.

9. A method as defined in claim 8 wherein said acute angle is approximately ten degrees or less.

10. A method as defined in claim 8 wherein said conductive arms are configured as an isosceles triangle.

11. A method as defined in claim 1 wherein each said radiating element comprises tree terminations for adjusting said effective electrical length.

12. A method as defined in claim 1 further comprising the step of locating each said radiating element within the range of from approximately three feet (0.91 meters) above the earth's surface to approximately two feet (0.61 meters) below the earth's surface.

13. A method for matching the impedance of each radiating element of a low-profile antenna system to the impedance of a transmission line, the method comprising the steps of:

obtaining one or more radiating elements which each have an effective electrical length that is approximately one half wavelength in a given medium at the lowest frequency in a range of desired operating signal frequencies, each said radiating element being electrically insulated substantially throughout its length, and each said radiating element comprising two conductive arms joined together at one end thereof;

capacitively coupling each said radiating element to the earth's surface so that the impedance variations of said radiating element are substantially damped over said selected range of operating signal frequencies; and coupling the transmission line to the conductive arms of each radiating element through an impedance matching means and essentially matching the average magnitude of the impedance of said antenna over said desired range of signal frequencies to the impedance of the transmission line when each said radiating element is positioned in proximity to the earth's surface.

14. A method as defined in claim 13 wherein each said conductive arm comprises a first end and a second end, said first ends being joined so as to form an acute angle, and wherein the coupling step comprises connecting the impedance matching means to said first ends of the conductive arms.

15. A method as defined in claim 14 wherein said conductive arms of each radiating element are configured as an isosceles triangle.

16. A method as defined in claim 15 wherein each radiating element comprises tree terminations for adjusting said effective electrical length.

17. A method as defined in claim 14 further comprising the step of locating each radiating element within the range of from approximately three feet (0.91 meters) above the earth's surface to approximately two feet (0.61 meters) below the earth's surface.

18. A method as defined in claim 14 wherein said acute angle is approximately ten degrees or less.

19. A method as defined in claim 18 wherein said conductive arms of each radiating element are substantially equal in length.

20. A method as defined in claim 19 wherein said desired operating range of electromagnetic signal frequencies comprises at least two octaves selected from a frequency range of from 30 KHz to 300 MHz.

21. A method as defined in claim 20 wherein said effective electrical length of both said radiating elements is approximately 200 feet (60.96 meters).

22. A method as defined in claim 21 wherein said transmission line is a 50 ohm coaxial transmission line and wherein said impedance matching means comprises a balance-to-unbalance transformer having an impedance step-up ratio of approximately nine-to-one.

23. A method of providing a low-profile broad band antenna system, the method comprising the steps of:

obtaining a pair of radiating elements with an effective electrical length of one half wavelength in a given medium at the lowest frequency in a desired operating range of electromagnetic signal frequencies, said radiating elements being electrically insulated substantially throughout their length, and said radiating elements each comprising two conductive arms having a first end and a second end, the first ends of the linear conductive arms being joined;

positioning each radiating element in proximity to the earth's surface such that each radiating element is located within the range of from approximately three feet (0.91 meters) above the earth's surface to approximately two feet (0.61 meters) below the earth's surface;

coupling a transmission line to said first end of each conductive arm of the radiating element through an impedance matching means;

substantially matching the average magnitude of the impedance of said antenna over said desired operating range of electromagnetic signal frequencies to the impedance of said transmission line when each said radiating element is positioned in proximity to the earth's surface; and connecting said transmission line to a transmitter/-receiver apparatus.

24. A method as defined in claim 23 wherein said conductive arms are configured as an isosceles triangle.

25. A method as defined in claim 24 wherein said radiating elements each comprise tree terminations for adjusting said effective electrical length.

26. A method as defined in claim 25 wherein said desired operating range of electromagnetic signal frequencies comprises at least two octaves selected from a frequency range of from 30 KHz to 300 MHz.

27. A method as defined in claim 26 wherein said transmission line is a 50 ohm coaxial transmission line and wherein said impedance matching means comprises a balance-to-unbalance transformer having an impedance step-up ratio of approximately nine-to-one.

28. A method as defined in claim 27 wherein the effective electrical length of said radiating element is approximately 200 feet (60.96 meters).

29. A broad band, low-profile antenna system, comprising:

a transmitter/receiver apparatus;

a transmission line connected to the transmitter/-receiver apparatus;

a pair of radiating elements capacitively coupled to the earth's surface so that the impedance variations of each radiating element are substantially damped over a selected range of signal frequencies comprising at least two octaves, each said radiating element comprising two conductive arms each having a first end and a second end, said first ends being joined; and impedance means connected to said first ends of each conductive arm for coupling said radiating elements to the transmission line, said impedance means comprising means for matching the impedance of said radiating elements to the impedance of said transmission line such that a VSWR of less than 2:1 is obtained over said selected range of frequencies.

30. A broad band, low-profile antenna system as defined in claim 29 wherein each radiating element is electrically insulated substantially throughout its length.

31. A broad band, low-profile antenna system as defined in claim 29 wherein said first ends are joined to form an acute angle.

32. A broad band, low-profile antenna system as defined in claim 29 wherein each radiating element is located within the range of from approximately three feet (0.91 meters) above the earth's surface to approximately two feet (0.61 meters) below the earth's surface.

33. A broad band, low-profile antenna system as defined in claim 29 wherein said conductive arms of each radiating element are configured as an isosceles triangle.

34. A broad band, low-profile antenna system as defined in claim 33 wherein each said radiating element comprises tree terminations for adjusting the effective electrical length of said radiating element.

35. A broad band, low-profile antenna system as defined in claim 29 wherein the effective electrical length of each radiating element is approximately one half wavelength in said medium at the lowest frequency of said desired operating range of electromagnetic signal frequencies.

36. A broad band, low-profile antenna system as defined in claim 35 wherein said conductive arms of each radiating element are substantially equal in length.

37. A broad band, low-profile antenna system as defined in claim 36 wherein said selected range of signal frequencies comprises at least two octaves selected from the LF to VHF frequency range.

38. A broad band, low-profile antenna system as defined in claim 37 wherein said radiating elements have a combined effective electrical length of approximately 200 feet (60.96 meters).

39. A broad band, low-profile antenna system as defined in claim 37 wherein said transmission line is a 50 ohm coaxial transmission line and wherein said impedance matching device comprises a balance-to-unbalance transformer having an impedance step-up ratio of approximately nine-to-one.

* * * * *

UNITED STATES PATENT AND TRADEMARK OFFICE

CERTIFICATE OF CORRECTION

PATENT NO. : 4,825,224

DATED : April 25, 1989

INVENTOR(S) : BRIAN L. GROSE et al.

It is certified that error appears in the above-identified patent and that said Letters Patent is hereby corrected as shown below:

Column 12, line 54, delete "means being selected such that"

Signed and Sealed this

Twenty-second Day of March, 1994

Bruce Lehman

*Attest:*

BRUCE LEHMAN

*Attesting Officer*

*Commissioner of Patents and Trademarks*